United States Patent [19]

Hiyoshi et al.

[11] 4,099,438

[45] Jul. 11, 1978

[54] ELECTRONIC MUSICAL INSTRUMENT HAVING A TOUCH VIBRATO EFFECT

[75] Inventors: Teruo Hiyoshi; Akira Nakada; Shigeru Yamada, all of Hamamatsu; Kiyoshi Ichikawa, Hamakita; Sigeki Isii, Hamamatsu, all of Japan

[73] Assignee: Nippon Gakki Seizo Kabushiki Kaisha, Hamamatsu, Japan

[21] Appl. No.: 723,757

[22] Filed: Sep. 16, 1976

[30] Foreign Application Priority Data

Sep. 17, 1975 [JP] Japan ..... 50-113036

[51] Int. Cl.[2] ..... G10H 1/02; G10H 5/00

[52] U.S. Cl. ..... 84/1.25

[58] Field of Search ..... 84/1.01, 1.24, 1.25, 84/DIG. 4, DIG. 5

[56] References Cited

U.S. PATENT DOCUMENTS

| | | | |
|---|---|---|---|
| 3,882,751 | 5/1975 | Tomisawa et al. | 84/1.01 |
| 3,951,030 | 4/1976 | Deutsch | 84/1.25 |
| 3,979,996 | 9/1976 | Tomisawa et al. | 84/1.25 |

FOREIGN PATENT DOCUMENTS

| | | | |
|---|---|---|---|
| 339,225 | 4/1930 | United Kingdom | 84/1.25 |

*Primary Examiner*—Stanley J. Witkowski
*Attorney, Agent, or Firm*—Spensley, Horn & Lubitz

[57] ABSTRACT

An electronic musical instrument is of a type wherein musical tone waveforms are stored in a memory as their sampled amplitudes and sequentially and repetitively read out to constitute tone waveforms. A key depression brings forth frequency information in a digital representation. The frequency information is accumulated to make an address signal for reading out the waveform memory. When a depressed key is moved laterally, a touch detection circuit produces an analog detection signal representing the amount of displacement of the key. In the meanwhile, a clock pulse is counted by an up-down counter and the counting output is converted by a D-A converter to an analog signal to obtain a triangular wave function signal. When the analog detection signal coincides, in amplitude, with the triangular wave function signal, the digital signal from the up-down counter is sampled and held by a sample and hold circuit. Thus a digital signal representing the key displacement is obtained. This digital signal is multiplied with a frequency information in a multiplier and, accordingly, the musical tone frequency is modulated in response to the lateral movement of the key. Thus, the touch vibrato effect is obtained.

6 Claims, 7 Drawing Figures

ELECTRONIC MUSICAL INSTRUMENT HAVING A TOUCH VIBRATO EFFECT

BACKGROUND OF THE INVENTION

1. Field of the Invention

This invention relates to an electronic musical instrument and, more particularly, to an electronic musical instrument wherein a touch vibrato effect is imposed on a digital representation of a musical tone.

2. Description of the Prior Art

Touch vibrato in an electronic musical instrument such as an electronic organ, an electric piano, etc. is used to change the frequency of a musical tone in response to the reciprocating lateral movements of the key operated by a player of the instrument. In prior art analog electronic musical instruments, this has been provided by modulating the frequency of a generated analog tone signal using an analog signal obtained by detecting the reciprocating laternal movements of the key. However, since the musical tones are formed in a digital manner in a digital electronic musical instrument, it is difficult to use conventional techniques to modulate the frequency of the musical tone signal in response to an analog touch signal.

SUMMARY OF THE INVENTION

The present invention facilitates touch vibrato in a digital electronic musical instrument by modulating the frequency of the musical tones in response to the reciprocating lateral movements of the depressed key (or the reciprocating elevational movements of the depressed key). According to the present invention, the analog signal obtained by detecting the touch movement of displaced amount of the key depressed is not converted directly to a digital signal but is converted indirectly to the digital signal. That is, a periodic function expressed by binary numerals such as a triangular waveform is initially generated, and this function is converted into an analog signal with the result that the analog amount of the function is compared with that of the touch detection signal. Then, when the former coincides with the latter, the binary numerals of the aforesaid function is sampled. The binary numerals thus sampled are utilized as the digital signal for the frequency modulation. In general, sufficient resolution cannot be obtained by directly converting the analog signal representing the displaced amount of the key depressed to the digital signal so that enough vibrato effect cannot be expected in the electronic musical instrument.

In principle of the electronic musical instrument according to the present invention, the frequency information of the constants corresponding to the frequencies of the keys depressed is repeatedly added cumulatively at regular timing intervals, and the amplitudes of the sequentially sampled waveform stored in a musical tone waveform memory are read out at a constant period with the accumulated results being as address signal so as to form musical tones. The frequency information is modulated or multiplied with the functional binary values thus sampled thereby modulating the reading period of the musical tone waveform memory so as to perform the vibrato effect. Thus, since the function indicated by digital amount can considerably be generated at relatively high speed with a counter and the like according to the present invention, it is preferred to provide a high speed sampling. According to one aspect of the present invention, there is provided an electronic musical instrument of the type for reading out the amplitudes of sequentially sampled musical tone waveforms by the cumulative addition of constants corresponding to the frequencies of musical tones to be generated at constant timing intervals, the instrument comprising means for detecting the reciprocating lateral displacements of key depressed thereby producing analog signal corresponding to the displaced amount of the key depressed, means for generating a digitally periodic function, means for converting the digitally periodic function to analog value and sampling the digital value of the periodic function when the analog value coincides with the value of the analog signal of the displaced amount of the depressed key, and means for modulating the value of the constants with the sampled digital value.

It is an object of the present invention to provide an electronic musical instrument which can achieve a touch vibrato effect in a digital type.

It is another object of the present invention to provide an electronic musical instrument capable of providing good resolution of functional waveform so as to accomplish the touch vibrato of high resolution.

It is a further object of the present invention to provide an electronic musical instrument capable of modulating the frequency of the musical tones in response to the reciprocating laternal movements of the keys depressed.

It is still another object of the present invention to provide an electronic musical instrument capable of repeatedly and cumulatively adding the frequency informations of the constants corresponding to the frequencies of the keys depressed at regular timing intervals.

It is still another object of the invention to provide an electronic musical instrument capable of reading out the amplitudes of the sequentially sampled waveform at a constant period with the accumulated results being as address signal so as to form musical tones.

It is still another object of the invention to provide an electronic musical instrument which can modulate the frequency information with the functional binary values sampled so as to perform the vibrato effect.

These and other objects and features of the invention will become more apparent in conjunction with the following description and drawings which are included for illustration purpose only.

DESCRIPTION OF THE PREFERRED EMBODIMENTS

Figure 1:
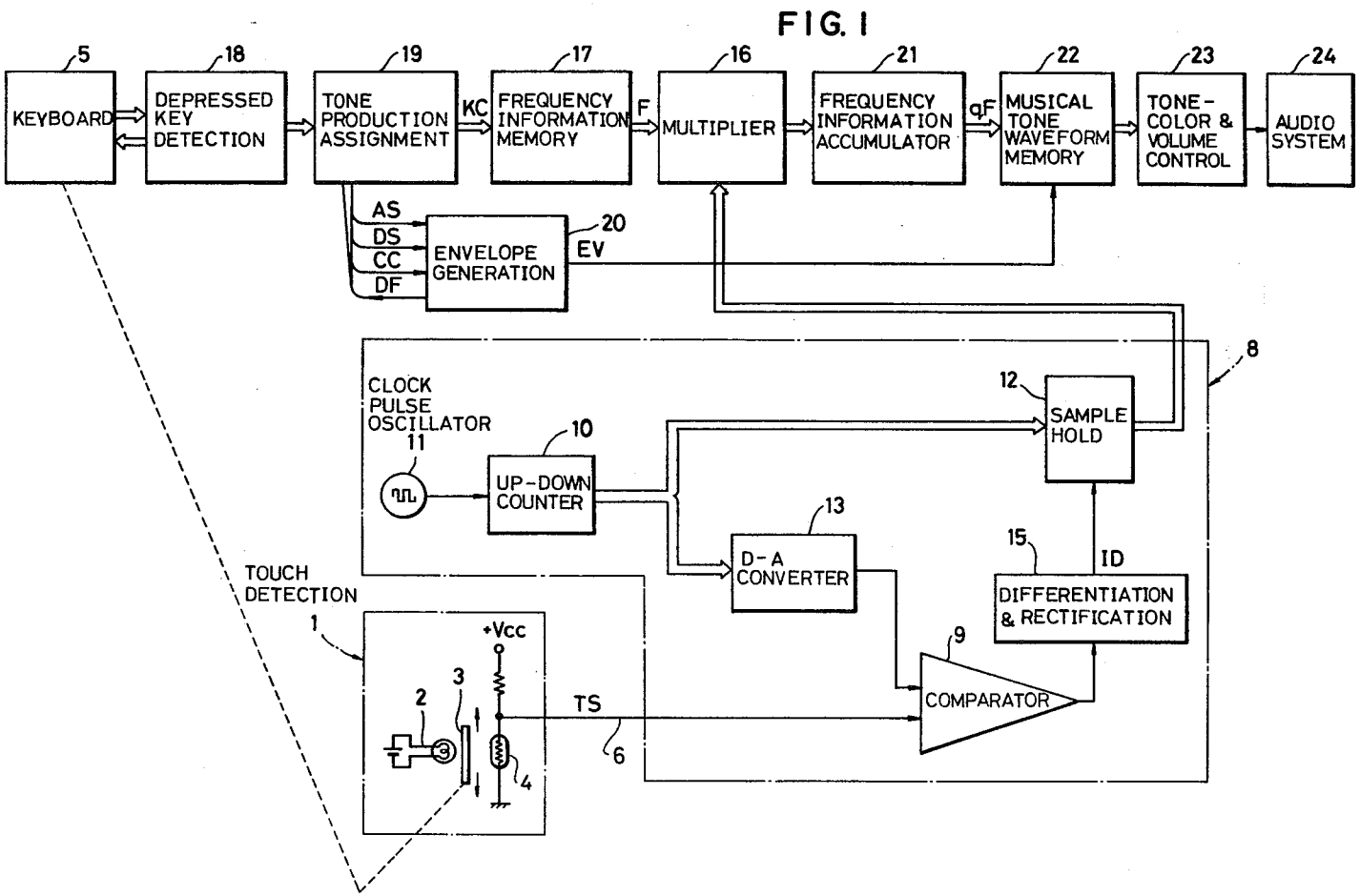
FIG. 1 is a block diagram of one embodiment of the electronic musical instrument constructed according to the present invention.

Referring first to FIG. 1, which shows one preferred embodiment of the present invention, a touch detection circuit 1 detects the reciprocating lateral displacement amount of a key of a keyboard 5. The light transmitted from a light emission element 2 irradiates a photoelectric converting element or photoelectric transducer 4 through a shutter plate 3, and the light amount thus received by the photoelectric transducer 4 varies in response to the displacement of the shutter plate 3 reciprocatingly laterally moved. The shutter plate 3 is adapted to be moved or displaced in cooperation with the reciprocating lateral displacements of the key depressed in the keyboard 5, Accordingly, the analog signal varying in response to the reciprocating lateral displacements of the key can be obtained from the photoelectric converting element 4, and the voltage of the transducer element 4 is outputted through a line 6 from the touch detection circuit 1 so as to thus provide an analog touch detection signal TS. Thus, the touch detection circuit 1 comprises the light emission element 2 for emitting a light, the shutter member of plate 3 passing the light from the light emission element 2 therethrough, and the photoelectric converting element 4 for receiving the light emitted from the light emission element 2 through the shutter member 3 thereby producing the analog touch detection signal TS therefrom.

Figure 2:
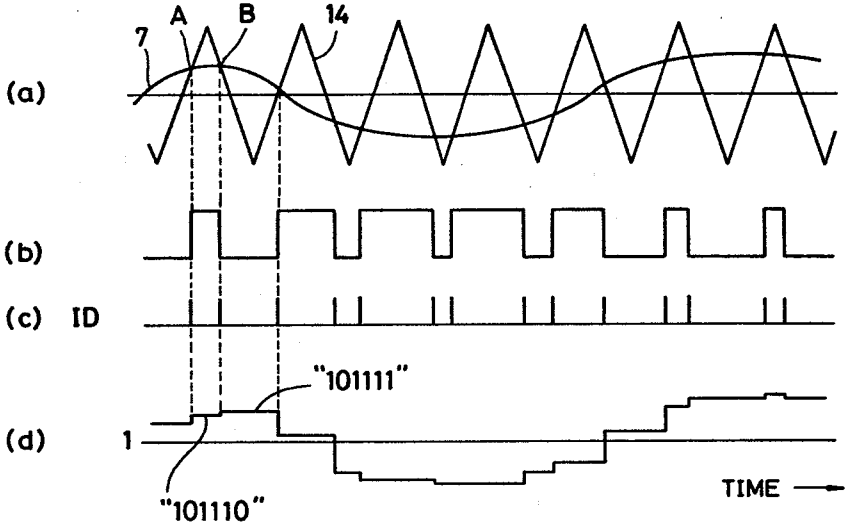
FIGS. 2(a) through 2(d) are timing charts for the explanatory purpose of a touch vibrato control circuit in the embodiment of the invention.

During the performance of the electronic musical instrument such as an electronic organ by a player thereof, when the player laterally moves reciprocatingly the depressed key in the keyboard 5, the shutter plate 3 is vibrated periodically so that there is present analog touch detection signal TS, which will hereinafter be referred to as a touch vibrato detection signal, varying periodically as shown by a curve 7 in FIG. 2(a) at the output line 6 of the touch detection circuit 1. The afore-described touch detection circuit 1 may be employed from those already known by those skilled in the art.

The touch vibrato detecting signal TS at the line 6 from the touch detection circuit 1 is applied to a comparator 9 in a touch vibrato control circuit 8. The touch vibrato control circuit 8 comprises an up-down counter 10 which counts clock pulses of relatively high speed supplied from a clock pulse oscillator 11 for generating periodic function represented by a binary signal.

Figure 3:
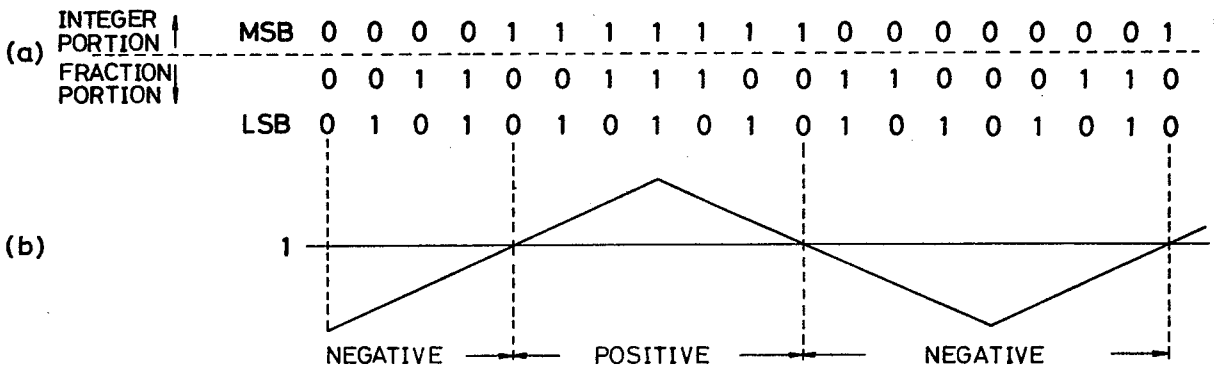
FIGS. 3(a) and 3(b) are graphs for explaining the function of a triangular waveform outputted from the up-down counter of the embodiment shown in FIG. 1.

Assume that the capacity of the counter 10 is, for example, 3 bits for simplification of explanation, the counted content of the counter 10 varies as shown in FIG. 3(a) as the clock pulses are applied thereto from the clock pulse oscillator 11. That is, the up-down counter 10 operates to up-count the clock pulses from the clock pulse oscillator 11 when it counts from minimum value so that the up-down counter 10 thus incressingly counts the clock pulses, but the counter 10 operates to down-count the clock pulses from the clock pulse oscillator 11 when it counts from maximum as it has counted to its maximum so that the counter 10 thus decreasingly counts the clock pulses to decrease the counted value. Consequently, the up-down counter 10 operates to repeatedly up-count and down-count the clock pulses so as to repeatedly increase and decrease its counted values as shown in FIG. 3(a) to thus generate a triangular waveform function as shown in FIG. 3(b). As the period of the most significant bit MSB of the-counted output of the counter 10 inverted to "1" or "0" coincides with one period of the aforementioned triangular waveform, assuming that the weight of the value of the most significant bit MSB corresponds to 1 in a decimal notation, the triangular waveform of the binary output signal from the counter 10 repeatedly varies increasingly and decreasing its values in the range of fraction number with 1 in decimal notation being taken as a center. Assuming also that the region in which the triangular waveform changes its value in the direction of numbers larger than 1 in decimal notation is positive while the region in which the triangular waveform varies its value in the direction of numbers smaller than 1 in decimal notation is negative, the positive and negative regions are as shown in FIGS. 3(a) and 3(b).

The counted output of the up-down counter 10 is applied to both a sample hold circuit 12 and a digital-analog converter 13 in the touch vibrato control circuit 8.

The digital-analog converter or D-A converter 13 serves the function of converting the triangular waveform function expressed by a binary numeral into an analog signal voltage. It is preferred that when the input digital triangular waveform functional value is 1 in a decimal notation, i.e., at the center of their variations, the conversion rate is so determined as to produce an analog output coinciding with the analog amount of the touch vibrato detection signal TS inputted from the touch detection circuit 1 to the comparator of the touch vibrato control circuit 8 in the steady state that the key is not reciprocatingly moved laterally. Therefore, the analog output of the D-A converter 13 becomes as shown by a curve 14 in FIG. 2(a) so that the center of the increasing and decreasing variations of the triangular waveform represented by the analog amount coincides with that of the touch vibrato detection signal TS shown by the curve 7. In addition, the output of the D-A converter 13 is applied to the other input of the comparator 9 for comparing the output of the D-A converter 13 with the touch vibrato detection signal TS delivered from the touch detection circuit 1. The comparator 9 produces an output signal "1" as illustrated in FIG. 2(b) when the output level of the D-A converter 13 indicated by the curve 14 in FIG. 2(a) is higher than the level of the touch vibrato detection signal TS shown by the curve 7 in FIG. 2(a). The output of the comparator 9 is applied to a differentiation and rectification circuit 15 for differentiating the rise and fall of the compared output signal of the comparator 9 and also for rectifying (including inverting the negative one) the differentiated rise and fall pulses in a positive direction as shown in FIG. 2(c) thereby producing the rectified output. As clearly seen from FIGS. 2(a)–(c) the comparator 9 and the differentiation and rectification circuit 15 integrally form a coincidence detection circuit which produces a pulse signal ID from the differentiation and rectification circuit 15 when the output of the DA converter 13 coincides with the analog amount of the touch vibrato detection signal TS. The coincidence detection pulse ID illustrated in FIG. 2(c) outputted from the differentiation and rectification circuit 15 is applied to the sample hold circuit 12 as a sampling gate control signal.

The sample hold circuit 12 has a sampling gate (not shown) and a hold circuit such as, for example, a capacitor, not shown, in parallel corresponding to the respective bits of the counted outputs of the up-down counter 10 and samples to hold the counted output of the counter 10 upon receipt of the coincidence detection pulse ID from the differentiation and rectification circuit 15. Since the coincidence detection pulses ID are produced when the curve 7 crosses the curve 14 in FIG. 2(a), the digital function value of the triangular waveform corresponding to the respective crossing points of the curve 14 are read by the sample hold circuit 12 at every point and are held until another functional value is then read out thereby. Accordingly, the timing variation of the output of the sample hold circuit 12 may be as shown in FIG. 2(d). Assuming that the counted output of the up-down counter 10 is, for example, 6 bits and the value of the counted output of the up-down counter 10 is "1 0 1 1 1 0" (1.4385 in decimal notation) at the cross point A in FIG. 2(a), the binary numeral of "1 0 1 1 1 0" is held and outputted at the sample hold circuit 12 as shown in FIG. 2(d). Assuming also that the counted output of the up-down counter 10 is "1 0 1 1 1 1" (1.4699 in decimal notation) at the cross point B, the binary numeral of "1 0 1 1 1 1" is outputted from the sample hold circuit 12. The sample hold circuit 12 samples the digital signal of the up-down counter 10, which, as is shown FIG. 2(d), obtains a similar result to a case where it samples the touch vibrato detection signal TS and converts it to digital signal as seen from the entirety of the touch vibrato control circuit. The resolution of the digital signal thus obtained is fairly satisfactory since it is determined by the counted output of the counter 10 which is a pure digital element.

The binary output of the sample hold circuit 12 virtually follows the touch vibrato operation by the player of the electronic musical instrument to repeat the increasing and decreasing variations of the value substantially periodically with 1 in a decimal notation as a center and is applied to a multiplier 16 as a multiplier input. A frequency information F is applied to the multiplier 16 as a multiplicand from a frequency information memory 17. The multiplier 16 multiplies the frequency information F being constant corresponding to the frequency of the key depressed by the output of the sample hold circuit 12 to follow the touch vibrato operation of the player of the electronic musical instrument so as to substantially change the frequency information F periodically increasingly and decreasingly. Thus, the musical tone under the touch vibrato control is generated as will hereinafter be further described in greater detail.

In FIG. 1, a depressed key detection circuit 18 detects the making or breaking operation of key switches of the respective keys arranged at the keyboard 5 and produces a depressed key identification signal output.

A tone production assignment circuit 19 receives the depressed key identification signal from the depressed key detection circuit 18 and assigns it to any of the channels corresponding to the same number as a maximum number of musical tones to be simultaneously produced (e.g. 12 channels as in the present embodiment). The tone production assignment circuit 19 has memory units corresponding to the respective channels for storing key codes KC representing the key at the memory units corresponding to the channels thus assigned with the musical tones of certain keys and successively and sequentially outputting the key codes KC stored in the respective channels in a time-sharing manner. Accordingly, in case where a plurality of keys are simultaneously depressed in the keyboard 5, the respective depressed keys are assigned separately to the respective channels of the musical tones, and the key codes KC expressing the assigned keys are stored in the respective memory units corresponding to the respective channels. The respective memory units may be composed of circulating shift registers. The tone production assignment circuit 19 is known per se, and typical embodiments are shown e.g., in FIG. 9 of U.S. Pat. No. 3,882,751 and in FIG. 4 of U.S. Pat. No. 3,979,996 both to Tomisawa et al.

The tone production assignment circuit 19 outputs an attack start signal or key-on signal AS representing that the depressed keys should produce musical tones at thus assigned channels in synchronization with the respective channel times in a time-sharing manner. Further, the tone production assignment circuit 19 also outputs a decay start signal or key-off signal DS representing that the keys assigned for the respective channels of the musical tones have been released and that the musical tones should thereby decay in synchronization with the respective channel times in times sharing fashion. These signals AS and DS are utilized for the amplitude envelope control or tone production control of the musical tone. Further, the tone production assignment circuit 19 receives a decay finish signal DF representing that the tone production at that channel is finished i.e. that the decay is finished from an envelope generation circuit 20, which will hereinbelow be further described in greater detail and produces a clear signal CC for clearing the various memory relative to the corresponding channels to completely remove the tone production assignment based on the decay finish signal DF from the envelope generation circuit 20.

Since the depressed key detection circuit 18 and the tone production assignment circuit 19 may employ those known by those skilled in the art, the detailed circuit arrangements thereof will not be described any further, but they may also adopt any other than those within the spirit of the scope of the present invention.

Inasmuch as the key codes KC produced from the tone production assignment circuit 19 represent the depressed keys, respectively, these key codes KC is utilized for addressing signal to read out the numerical information intrinsic for the frequencies of the musical tones of the keys corresponding to the respective key codes KC from the frequency information memory 17.

The frequency information memory 17 may, for example, be constructed with a read only memory which stores the frequency information F (constant) in response to the key codes of the respective keys in advance. When a certain key code KC is applied to the frequency information memory 17, it reads out the frequency information F stored at the address identified by the key code KC thus applied thereto.

A frequency information accumulator 21 is adapted to regularly make sequentially cumulative addition of the frequency information F to address the amplitude samples of the musical tone waveform at every predetermined constant time, and the frequency information F is digital numerals proportional to the frequencies of the musical tones of the corresponding keys, which may be 15-bit binary numeral signal. This frequency information F is numeral value including an integer portion and an fraction portion expressed by a radix point notation wherein the most significant bit of the 15 bits corresponds to the integer portion, and the rest of the 15 bits, i.e., 14, represent the fraction portion.

The value of the frequency information F can be unitarily determined under a predetermined sampling speed if the value of the musical tone frequency is once specified. For example, assume that when the value $q$F, where $q$ represents 1, 2, 3,..., sequentially accumulated with the frequency information F by the frequency information accumulator 21 becomes 64 in a decimal notation, the sampling of one musical tone waveform is completed and that the cumulative addition of the frequency information F is made in every 12 $\mu$s circulating the entire channel time in one cycle, $$F = 12 \times \Gamma \times f \times 10^{-6}$$

Thus, the value of the frequency information F is determined by this equation. The value "$f$" signifies the frequency of the musical tone. In this manner, this value of the frequency information F may preferably be stored in the frequency information accumulator 21 responsive to the frequency $f$ to be obtained. For example, the musical tone frequency corresponding to the note $C_2$ is 65.106Hz. From this the value of the frequency information F for the note $C_2$ is 0.052325. The values of the information F can also be obtained in the same manner.

The relationship between the frequencies and the values of the frequency informations F will now be described with some musical notes as examples in the following Table I.

Table I

| Musical Note | Frequency (Hz) | Frequency Information F — Binary Number — Integer Portion 15 | 14 | 13 | 12 | 11 | 10 | 9 | 8 | 7 | 6 | 5 | 4 | 3 | 2 | 1 | |
|---|---|---|---|---|---|---|---|---|---|---|---|---|---|---|---|---|---|
| | | Fraction Portion | | | | | | | | | | | | | | | |
| $C_2$ | 65.406 | 0 | 0 | 0 | 0 | 0 | 1 | 1 | 0 | 1 | 0 | 1 | 1 | 0 | 0 | 1 | 0.052325 |
| $C_3$ | 130.813 | 0 | 0 | 0 | 0 | 1 | 1 | 0 | 1 | 0 | 1 | 1 | 0 | 0 | 1 | 0 | 0.104650 |
| $C_4$ | 261.626 | 0 | 0 | 0 | 1 | 1 | 0 | 1 | 0 | 1 | 1 | 0 | 0 | 1 | 0 | 1 | 0.209300 |
| $C_5$ | 523.251 | 0 | 0 | 1 | 1 | 0 | 1 | 0 | 1 | 1 | 0 | 0 | 1 | 0 | 1 | 0 | 0.418600 |
| $C_6$ | 1046.502 | 0 | 1 | 1 | 0 | 1 | 0 | 1 | 1 | 0 | 0 | 1 | 0 | 1 | 0 | 0 | 0.837200 |
| $C_6$# | 1244.508 | 0 | 1 | 1 | 1 | 1 | 1 | 1 | 1 | 0 | 1 | 1 | 1 | 0 | 0 | 0 | 0.995600 |
| $E_6$ | 1318.510 | 1 | 0 | 0 | 0 | 0 | 1 | 1 | 1 | 0 | 0 | 0 | 0 | 0 | 0 | 1 | 1.054808 |
| $C_7$ | 2093.005 | 1 | 1 | 0 | 1 | 0 | 1 | 1 | 0 | 0 | 1 | 0 | 1 | 0 | 0 | 1 | 1.674400 |

The frequency information accumulator 21 makes cumulative addition of the frequency informations of the respective channels at a predetermined constant sampling speed (at a speed of 12 μs per every channel time) thereby obtaining the accumulated value $q$F resulting in advancing the phase of the musical tone waveform to be read out in every sampling time of 12 μs. When the accumulated value $q$F reaches 64 in a decimal notation, it overflows the counter and resume to "0" and thus completes the reading of one waveform. Since 64 expressed in a decimal notation can be indicated by 6-bit binary signal, in order to make cumulative addition of the frequency information F whose 1st order integer digit is at the fifteenth bit and to then store the respective counting result until the accumulated value $q$F becomes 64, the counter should have a word length of 20 bits where the first through the fourteenth bits represent the fraction portion and the fifteenth through twentieth bits represent the integer portion. It should be preferred that the frequency information accumulator 21 is consisting of 20-bit adder and a shift register of 12 stages/20 bits so as to commonly use the adder for the respective channels in a time-sharing manner.

A musical tone waveform memory 22 samples the musical tone waveform at plural phase points such as 64 thereby storing the values of amplitudes sequentially at the respective sampling points of the respective address. The values $q$F as the outputs of the frequency information accumulator 21 becomes the input specifiying the addresses to be read out from the musical tone waveform memory 22. The number of addresses of the musical tone waveform memory 22 is 64, and the data of the fifteenth through twentieth bits corresponding to the integer portion of the values $q$F is adapted to be applied to the musical tone waveform memory 22 as address inputs. The data of the first through fourteenth bits corresponding to the fraction section of the values $q$F are merely used in the frequency information accumulator 21 for the purpose of cumulative addition.

As the accumulated values $q$F are increased in the frequency information accumulator 21, the addresses for specifying the amplitudes of the sampled waveform to be read are successively and sequentially delivered for successively reading out the amplitudes of the sampled musical tone waveform from the memory 22.

The multiplier 16 provided between the frequency information memory 17 and the frequency information accumulator 21 multiplies the frequency information F by the output of the sample hold circuit 12 and applies the frequency information varying increasingly and decreasingly to the frequency information accumulator 21 as was previously described. As the frequency information accumulator 21 follows the touch vibrato operation to make the cumulative addition of the frequency information thus varying increasingly and decreasingly, the reading speed of the musical tone waveform memory 22 is varied accordingly. Accordingly, the frequency of the musical tone waveform read out from the musical tone waveform memory 22 is also varied. Inasmuch as the frequency information F repeats to vary increasingly and decreasingly with the original value read out from the frequency information memory 17 (the value for carrying out the original constant frequency of the depressed key) as a center, the frequency of the musical tone waveform read out from the musical tone waveform memory 22 also varies increasingly and decreasingly with the original frequency as a center. Thus, there is produced the musical tones with vibrato in response to the touch vibrato operation.

The envelope generation circuit 20 is known per se, and generates an envelope waveform EV for controlling the amplitude envelope of the musical tone. When the attack start signal AS is applied to the envelope generation circuit 20 from the tone production assignment circuit 19, the envelope generation circuit 20 generates an envelope of the attack portion, then remains a constant sustain level, and generates the envelope of the decay portion upon receipt of the decay start signal DS so as to fall the amplitude of the musical tone. A series of envelope waveforms EV varying timingly in a manner consisting of attack, sustain and decay portions are generated separately in every channel in a time-sharing manner so as to control the amplitude envelope of the musical tone waveform read out from the musical tone waveform memory 22. Typical examples of an envelope generation circuit 20 usable herein are shown in FIG. 13 of U.S. Pat. No. 3,882,751 and in FIG. 13 of U.S. Pat. No. 3,979,996 both to Tomisawa et al.

The musical tone signal thus controlled in envelope is applied to a tone-color and volume control circuit 23 which controls the tone-color and volume of the musical tone signal, and the musical tone signal thus controlled is applied to an audio system 24 which produces a musical tone.

It will be appreciated from the foregoing description that according to the circuit arrangement of the electronic musical instrument of the present invention, accurate touch vibrato can be achieved of the type digitally operated.

Although the invention has been described and illustrated in detail, it is to be understood clearly that the same is by way of illustration and example only and is not to be taken by way of limitation, the spirit and scope of this invention being limited only by the terms of the appended claims.

What is claimed is:

1. A system for producing touch vibrato in a digital electronic musical instrument of the type having a tone generator for generating a tone having a frequency proportional to a digital frequency number F, and note selection means for providing a selected frequency number F to said time generator, said instrument having a touch responsive member and means for producing an analog touch signal having a value proportional to displacement of that member, said system comprising:

signal providing means for providing a reference periodic signal having excursions greater than the maximum range of said touch signal, comparison means for comparing the value of the analog touch signal to the value of said reference periodic signal, and for providing a digital output each time said touch signal crosses said periodic signal, said digital output having a digital value corresponding to the value of said periodic signal at the point of crossing, and modulating means for modulating the frequency number F provided by said note selection means by the value of said digital output.

2. In an electronic musical instrument of the type including a tone generator that generates a tone having a fundamental frequency that is proportional to a frequency number F, and note selection means for providing a selected frequency number F to said tone generator, a system for providing a touch vibrato effect comprising:

a touch responsive member, touch transducer means for providing an analog touch signal TS proportional to displacement of said touch responsive member, signal providing means for providing a periodic analog signal, comparator means for comparing the value of said analog touch signal with the value of said periodic analog signal and for producing a coincidence signal each time that the compared values are equal, digital output means, connected to said comparator means, for producing a digital signal corresponding to the value of said periodic analog signal each time said comparator means produces said coincidence signal, and means for modifying said frequency number F provided from said note selection means by the value of said produced digital signal, thereby to frequency modulate said generated tone in response to displacement of said touch responsive member.

3. An electronic musical instrument according to claim 2 wherein said instrument has a keyboard and wherein said touch responsive member is a key of said keyboard, said key being displaceable laterally, said touch signal being proportional to lateral displacement of said key.

4. In a keyboard electronic musical instrument of a type wherein successively sampled amplitudes of a musical tone waveform are read from a memory at a rate established by a constant corresponding to the frequency of the musical tone, a system for providing a touch vibrato effect comprising:

touch detection means for detecting the amount of reciprocating lateral displacement of a depressed key, thereby to produce an analog signal corresponding to said amount of displacement;

a circuit for generating a digital periodic function;

a digital-to-analog converter for converting said digital periodic function to an analog value;

sampling means for sampling the digital value of said periodic function when said analog value coincides with the value of said analog signal corresponding to said amount of displacement; and a circuit for modulating the value of said constant by the sampled digital value.

5. An electronic musical instrument as defined by claim 4 where said circuit for generating a digital periodic function comprises a clock pulse oscillator for producing clock pulses and an up-down counter for counting the clock pulses, said up-down counter down-counting the clock pulses applied after a maximum count and up-counting the clock pulses applied after a minimum count whereby a digital periodic function of a triangular waveform is produced.

6. An electronic musical instrument as defined in claim 4 wherein said sampling means comprises:

a comparator for comparing the analog signal from said touch detection means with the analog value from said digital-to-analog converter to produce a binary signal having one binary state if said analog signal is larger than said analog value, and having the other binary state otherwise;

a circuit for differentiating and rectifying the output of said comparator to produce a pulse signal each time said binary signal changes state; and a circuit for sampling the digital periodic function produced by said generating circuit each time that said pulse signal occurs, and for holding the resultant sample until occurrence of the next pulse signal.

* * * * *